US008653479B2

(12) United States Patent
Carroll et al.

(10) Patent No.: US 8,653,479 B2
(45) Date of Patent: Feb. 18, 2014

(54) METHOD AND APPARATUS FOR TAGGING INDIVIDUALS FOR IDENTIFICATION AND TRACKING

(75) Inventors: Jonathan Briggs Carroll, Broomfield, CO (US); Paul Martens, Boulder, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 267 days.

(21) Appl. No.: 12/949,219

(22) Filed: Nov. 18, 2010

(65) Prior Publication Data

US 2011/0233426 A1 Sep. 29, 2011

Related U.S. Application Data

(60) Provisional application No. 61/317,734, filed on Mar. 26, 2010.

(51) Int. Cl.
*G01N 21/64* (2006.01)

(52) U.S. Cl.
USPC ..... 250/458.1; 250/461.1

(58) Field of Classification Search
USPC ..... 250/458.1–461.1
See application file for complete search history.

(56) References Cited

U.S. PATENT DOCUMENTS

| | | | | |
|---|---|---|---|---|
| 3,358,602 | A | 12/1967 | Chope | |
| 3,661,088 | A * | 5/1972 | Harr et al. | 102/215 |
| 3,745,324 | A | 7/1973 | Shefler et al. | |
| 3,888,182 | A * | 6/1975 | Breed | 102/272 |
| 3,934,149 | A | 1/1976 | Nehrich, Jr. et al. | |
| 4,007,690 | A | 2/1977 | Wildridge | |
| 4,329,393 | A | 5/1982 | LaPerre et al. | |
| 5,661,257 | A | 8/1997 | Nielson et al. | |
| 5,760,394 | A * | 6/1998 | Welle | 250/303 |
| 6,025,200 | A | 2/2000 | Kaish et al. | |
| 6,412,416 | B1 | 7/2002 | Rouse et al. | |
| 6,989,525 | B2 | 1/2006 | Howard | |
| 2002/0021003 | A1 * | 2/2002 | McGrew | 283/93 |
| 2002/0174794 | A1 * | 11/2002 | Lowden et al. | 102/517 |
| 2009/0224218 | A1 | 9/2009 | Williams et al. | |
| 2009/0304152 | A1 | 12/2009 | Adamski et al. | |

* cited by examiner

*Primary Examiner* — Casey Bryant
(74) *Attorney, Agent, or Firm* — Ronald E. Prass, Jr.; Prass LLP

(57) ABSTRACT

A method and apparatus that are useful for tagging personnel for identification and tracking is disclosed. The apparatus may include a taggant, the taggant being a chemical substance that adheres to at least one of human skin, clothing and equipment of personnel and is undetectable by the human eye, and a taggant deployment mechanism that includes the taggant and is configured to release the taggant upon activation of a triggering mechanism, wherein the taggant deployment mechanism is configured such that when the triggering mechanism is activated, the taggant is released from the taggant deployment mechanism and adheres to at least one of human skin, clothing and equipment of personnel within a radius of a point that the taggant is released, the taggant being detectable only by a taggant detection unit.

8 Claims, 4 Drawing Sheets

METHOD AND APPARATUS FOR TAGGING INDIVIDUALS FOR IDENTIFICATION AND TRACKING

PRIORITY INFORMATION

This application claims priority from U.S. Provisional Patent Application Ser. No. 61/317,734, filed Mar. 26, 2010, the content of which is incorporated herein by reference in its entirety.

BACKGROUND

1. Field of the Disclosed Embodiments

The disclosure relates to tagging individuals for identification and tracking.

2. Introduction

Engagements in the current combat theaters of Iraq and Afghanistan often involve non-uniformed insurgents firing from a hidden location, then retreating to a populated area and blending in with civilians. This tactic gives insurgents a significant asymmetric advantage by defying internationally recognized rules of war. To maintain a civil relationship with the people and governments, U.S. soldiers and commanders must be very cautious when trying to find insurgents hiding among civilians. Many times insurgents escape, only to engage in a conflict at a later time. Defying the rules of war pays off for insurgents, and they are not likely to ever change their thinking.

The ability to distinguish insurgents from civilians would be a great advantage to the warfighter. The immediate return would include the capture and neutralization of insurgents recently involved in a firefight. More profound results include the tracking of insurgents back to their hideout, development of retreat patters for counter-ambush, and the evidence-based prosecution of unlawful combatants.

SUMMARY OF THE DISCLOSED EMBODIMENTS

A method and apparatus that are useful for tagging personnel for identification and tracking is disclosed. The apparatus may include a taggant, the taggant being a chemical substance that adheres to at least one of human skin, clothing and equipment of personnel and is undetectable by the human eye, and a taggant deployment mechanism that includes the taggant and is configured to release the taggant upon activation of a triggering mechanism, wherein the taggant deployment mechanism is configured such that when the triggering mechanism is activated, the taggant is released from the taggant deployment mechanism and adheres to at least one of human skin, clothing and equipment of personnel within a radius of a point that the taggant is released, the taggant being detectable only by a taggant detection unit.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION OF THE DISCLOSED EMBODIMENTS

Figure 1:
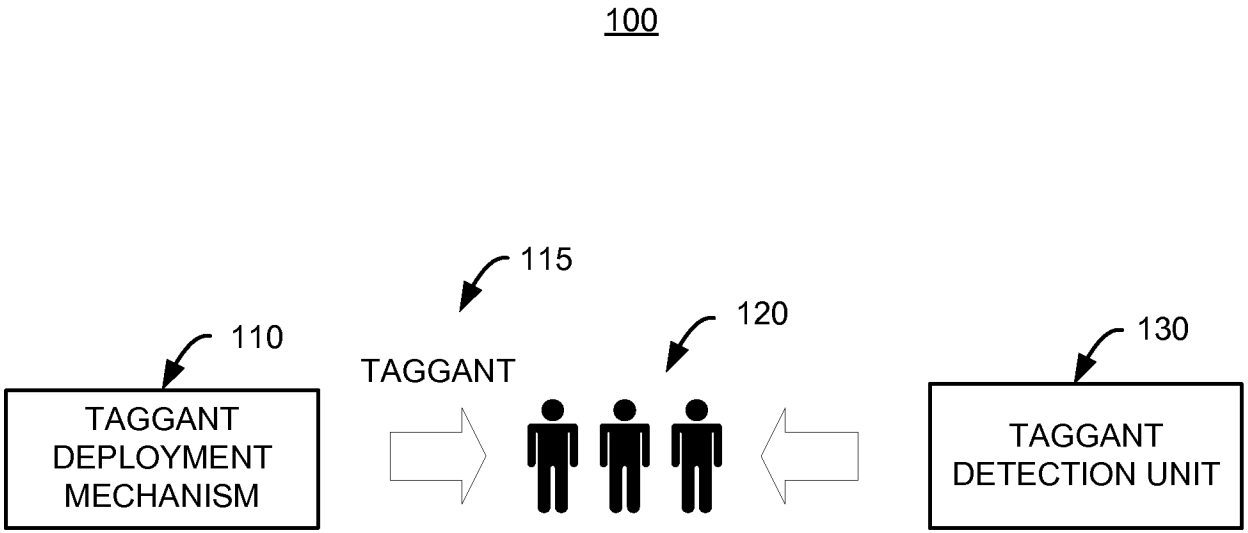
FIG. 1 is a diagram of an exemplary taggant deployment and sensing environment in accordance with a possible embodiment of the disclosure.

Additional features and advantages of the disclosure will be set forth in the description which follows, and in part will be obvious from the description, or may be learned by practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth herein.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The disclosed embodiments may concern a new tagging and detection method and apparatus for use by ground forces against insurgents in modern combat environments. Insurgents are able to retreat from combat and easily hide among civilian populations. Currently, finding and isolating such camouflaged enemies is difficult and risks offending or endangering civilians and the local government. The disclosed embodiments describe a solution that may allow a warfighter to tag insurgents during an engagement and detect them during or after they retreat.

A two-component tagging and detection system may include a deployable fluorescent tagging chemical and a mobile tag-detection detector or sensor. The tagging chemical may be deployed via 40 mm grenades compatible with the M203 or Mk19 grenade launchers, for example. Detonation of the grenade may disperse the tagging chemical over an area. The tagging chemical may land on the clothing and exposed skin of any insurgents within the area.

The tag detector may be an active sensor that may use a laser to induce fluorescence in the tagging chemical and a filtered optical system to detect the emitted wavelengths. The sensor may be used by an individual soldier at close-range, or deployed by vehicle or UAV for longer-range detection.

Engagement with insurgents may be initiated in several ways. A hidden group of insurgents may ambush a platoon on foot or vehicle patrol. Reconnaissance may discover the location of an insurgent force and deploy interception forces.

Once engagement has begun and the insurgent locations identified, the platoon's grenadier may target the insurgent locations with high-explosive (HE) grenades interspersed with tagging grenades. While the primary purpose of the tagging grenade is to tag the insurgent, it may also include some amount of HE and shrapnel for both lethality and disguise of its purpose. The engagement may continue until the insurgents retreat or are neutralized.

Neutralization of the insurgent force may be the favorable result. However, the tagging of the insurgents via tagging grenades may provide a valuable means of tracking them should they retreat. The tracking phase may take several forms.

Should the insurgents escape into a nearby crowd of non-combatants, vehicle-mounted and personnel-carried sensors may be used to locate tagged insurgents within the crowd. To disguise the technology, a lineup of civilians and insurgents can be interviewed by soldiers while the tag-detection sensor may be covertly employed from a stand-off position. Detections of tagged individuals may be secretly relayed to the interviewing soldiers. The tagged individuals may then be isolated and further searched, such as for a recently-fired weapon or gunpowder residue, at which they may be taken into custody and further interrogated. Disguise of the tagging and detection system may be furthered if the interviewing soldiers appear to use a more mundane technique, such as a photo-book, to seemingly detect the tagged individual.

If the insurgents attempt to flee through some varied terrain, UAV and vehicle-mounted taggant detection sensors may be employed to track the insurgents' retreat. These platforms may have the power supplies necessary to drive a longer-distance sensor, and may be rapid and mobile enough to follow insurgents through most terrain. At the very least, the vehicle or UAV may track the insurgents and convey their location to counter-ambush forces for interception. However, the vehicle or UAV may also carry the means to neutralize the insurgents once within range.

Should the decision be made to attempt to track the retreating insurgents in hope of discovering their hideout, a UAV-mounted tag-detection sensor may be deployed to covertly track them from a stand-off distance and report their location and direction of retreat. Upon finding the end-point of their retreat, tactical decisions may be made about whether and how to engage the suspected hideout.

Secondary usage scenarios may include the independent detection of a tagged individual during a raid, the collection of legal evidence, and the development of retreat patterns over time. After securing a location taken in a raid, a personnel-carried tag-detection sensor could be employed to detect any tagged individuals. The presence of such tagged individuals may indicate their participation in or witness of a prior engagement at which tagging grenades were deployed.

A tagging camera may be used to retain photograph evidence that an individual was tagged by a tagging grenade. This evidence may be used in criminal trials or shown to tribal leaders to identify insurgents within their populace. Friendly leaders might be more willing and able to intercede with an insurgent if evidence of their activity is available.

With the collection of data on several retreat events, review and analysis of that data may lead to the development of common retreat patterns following engagement. These developed patterns may assist with the placement of counter-ambush forces in positions better able to rapidly intercept insurgents retreating along the known paths.

The desired tagging chemical may be one that is activated by photons of a narrow bandwidth and fluoresces within a different narrow bandwidth. The detection bandwidth should not be in the near infrared (NIR), 700-1000 nm, due to the availability of IR detectors (i.e. Night Vision Imaging System (NVIS) goggles) among enemy forces, even insurgents. They may be likely to eventually discover the existence and purpose of the tagging chemical.

Several chemicals may be identified which react with ultraviolet (UV) radiation by fluorescing in the 1.0-1.1 micron band of IR light. The use of a UV laser and a sensor with a 1-1.1 micron band pass-filter may be used to activate and detect the tagging chemical, for example.

The tagging chemical may be deployed via grenade launcher. A small HE charge may disperse both the chemical and shrapnel on insurgents within the explosive range. Once the ideal activation and fluorescence bandwidths have been isolated, a prototype sensor can be created using commercially available equipment. After demonstrating the sensor, miniaturization and integration expertise may be used to assist with the outfitting of vehicles and the warfighter with tag-detection sensors.

The development and deployment of the tagging and detection system may greatly benefit the warfighter in tracking insurgents after an engagement. The potential to track insurgents to their hideouts, determine common retreat patterns, and provide evidence of insurgent activity may help overcome the disadvantage insurgents gain by violating the internationally recognized rules of war.

FIG. 1 is a diagram of an exemplary taggant deployment and sensing environment 100 in accordance with a possible embodiment of the disclosure. The exemplary taggant deployment and sensing environment 100 may include a taggant deployment mechanism 110, personnel 120, and a taggant detection unit 130.

For example, if friendly forces want to mark personnel 120 so that they are easily identified, such as opposing forces or insurgents, the friendly forces may deploy the taggant deployment mechanism 110 in the area of the personnel 120 and cover the personnel 120 with taggant 115 along with possibly a weapons payload. After being covered with taggant 115, the personnel may be detected by the taggant detection unit 130 operated by the friendly forces, for example. In this manner, personnel 115 (e.g., opposing forces, insurgents, etc.) may be easily identified in crowds and may not easily escape capture.

Figure 2:
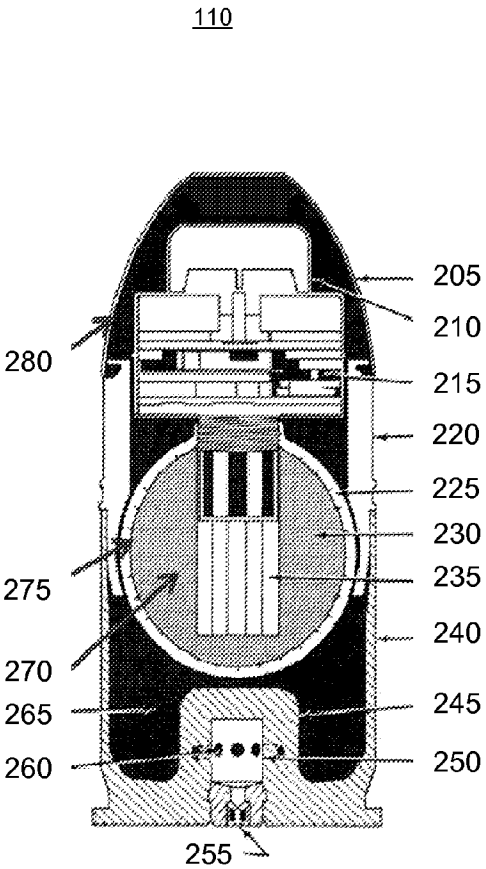
FIG. 2 is a diagram of an exemplary taggant deployment mechanism in accordance with a possible embodiment of the disclosure.

FIG. 2 is a diagram of an exemplary taggant deployment mechanism 110 in accordance with a possible embodiment of the disclosure. In this example, the taggant deployment mechanism 110 is shown as a weapons system, and in particular, a grenade. However, other taggant deployment mechanisms 110 may be used to deploy the taggant within the spirit and scope of the disclosed embodiments, including a missile, an artillery shell, a mortar, a handheld weapons system, a vehicle-mounted weapons system, or an explosive payload weapons system, for example.

The taggant deployment mechanism 110 (i.e., a grenade in this example) may include an aluminum ogive 205, pressure plate 210, fuze assembly 215, projectile skirt 220, grenade portion 225, explosive 230, detonator 235, cartridge case 240, retainer cup 245, high pressure chamber 250, base plug 255, and vent holes 260. One or more of the portions of the taggant deployment mechanism 110 may make up a triggering mechanism, include the pressure plate 210, the fuze assembly 215, and the detonator 235.

The taggant 115 may be included several areas in the taggant deployment mechanism 110 so that it may be deployed onto personnel. Exemplary FIG. 2 shows three possible areas where the taggant 115 may be located: 270, 275, and 280. In a first example 270, the taggant 115 may be mixed in with the explosive 230. In a second example 275, the taggant 115 may be mixed into an epoxy coating and may cover the explosive 230 before pressing into the grenade 225. In a third example 280, the taggant deployment mechanism 110 may be painted with an epoxy containing the taggant 115.

The taggant 115 used may be quantum dots, for example. However, other chemical substances may be used for the taggant 115 as long as they are not visible to the human eye and may be detected by the taggant detection unit 130. Note also, the taggant 115 may released in conjunction with an explosion, such as the explosion of the grenade shown in FIG. 3. The taggant 115 may be deployed along with shrapnel, or other weapons payloads, or the taggant 115 may be deployed by itself, for example.

Figure 3:
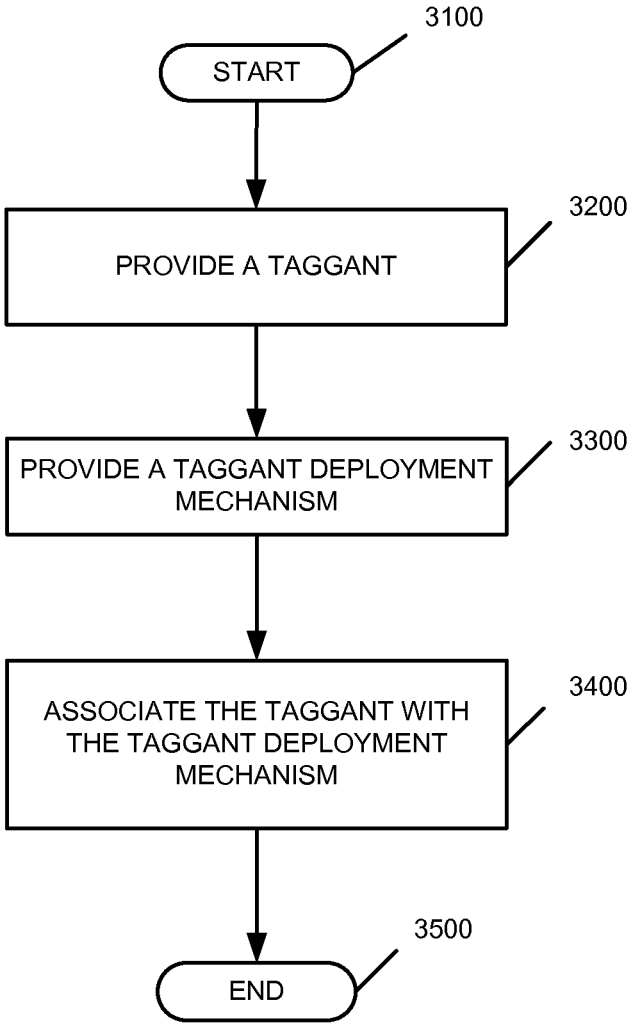
FIG. 3 is an exemplary flowchart illustrating a possible taggant deployment mechanism manufacturing process in accordance with one possible embodiment of the disclosure.

FIG. 3 is an exemplary flowchart illustrating a possible taggant deployment mechanism manufacturing process in accordance with one possible embodiment of the disclosure. The process may begin at step 3100 and may continue to step 3200 where a taggant 115 may be provided. The taggant 115 may be a chemical substance that adheres to the human skin, clothing or equipment of personnel 120 and may be undetectable by the human eye.

At step 3300, a taggant deployment mechanism 110 may be provided that may hold the taggant 115 and may be configured to release the taggant 115 upon activation of a triggering mechanism 210, 215, 235. At step 3400, the taggant 115 may be associated with the taggant deployment mechanism 110. In this manner, the taggant 115 may be place inside the taggant deployment mechanism 110 or may coat the outside of the taggant deployment mechanism 110, for example.

The taggant deployment mechanism 110 may be configured such that when the triggering mechanism 210, 215 235 is activated, the taggant 115 may be released from the taggant deployment mechanism 110 and may adheres to the human skin, clothing and/or equipment of personnel 120 within a radius of a point that the taggant 115 is released. The taggant 115 is configured such that is may be detectable only by a taggant detection unit 130.

Figure 4:
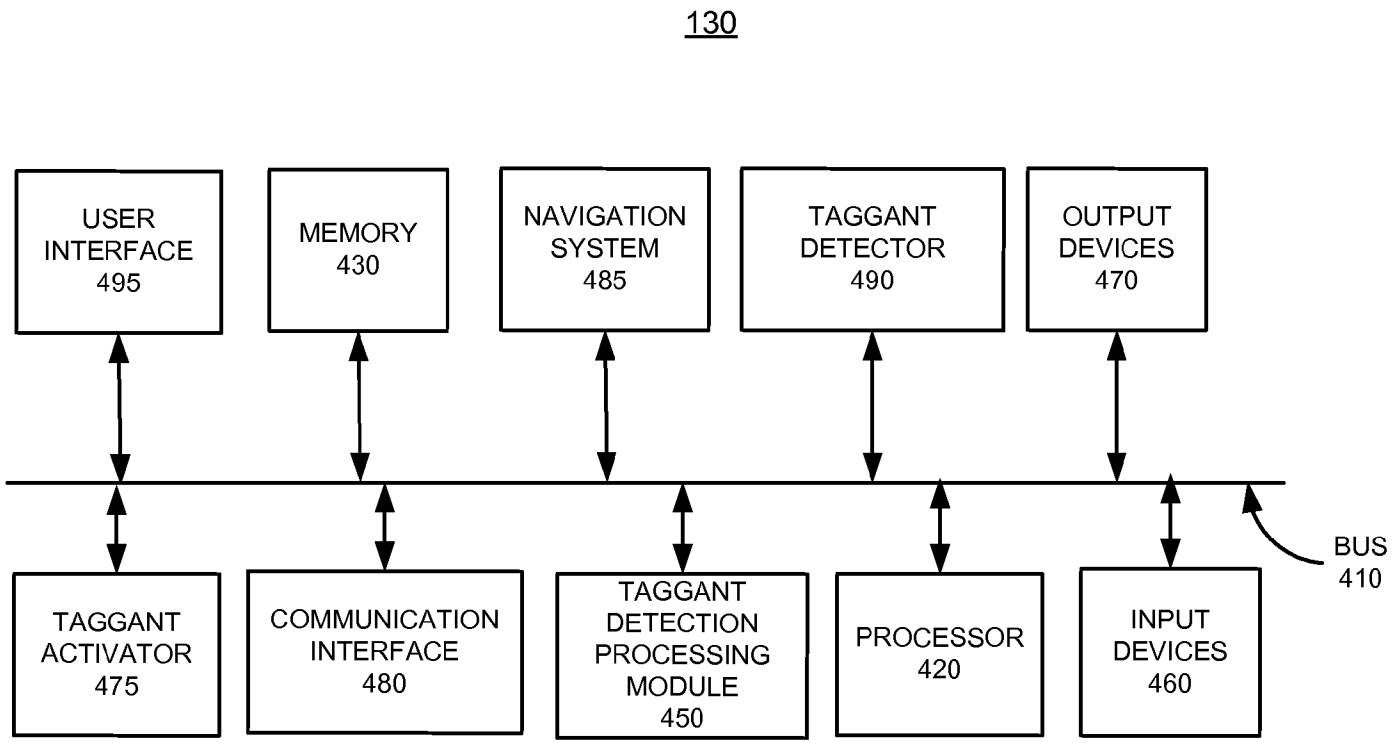
FIG. 4 is a diagram of an exemplary taggant detection unit in accordance with a possible embodiment of the disclosure.

FIG. 4 is a diagram of an exemplary taggant detection unit 130 in accordance with a possible embodiment of the disclosure. The taggant detection unit 130 may be handheld, vehicle-mounted (e.g., car, jeep, tank, high-mobility multipurpose wheeled vehicle (NMMWV or "HUMVEE", personnel carrier, etc.), stationary object-mounted (e.g., building, post, pole, helmet, weapons, etc.), or aircraft-mounted (e.g., unmanned aerial vehicle (UAV), airplane, helicopter, etc.).

The taggant detection unit 130 may include bus 410, processor 420, memory 430, taggant detection processing module 450, input devices 460, output devices 470, communication interface 480, navigation system 485, taggant detector 490, taggant activator 475, and user interface 495. Bus 410 may permit communication among the components of the taggant detection unit 130.

Processor 420 may include at least one conventional processor or microprocessor that interprets and executes instructions. Memory 430 may be a random access memory (RAM) or another type of dynamic storage device that stores information and instructions for execution by processor 420. Memory 430 may also include a read-only memory (ROM) which may include a conventional ROM device or another type of static storage device that stores static information and instructions for processor 420.

The navigation system 485 may be included to provide the line of sight and position of the taggant detector 490. The taggant activator 475 may be a LED, laser, or any other device capable of producing UV, visible, or IR light.

The taggant detector 490 may be any detector that may sense a taggant 115 after it has been activated by the taggant activator 493, or by ambient light. As stated above, the taggant 115 may be a chemical substance that adheres to the human skin, clothing and/or equipment of personnel 120 and may be undetectable by the human eye.

The taggant activator 475 may be modulated to encode a signal. The encoded signal could be compared to the signal from the taggant detector 490 using the detection processing module 450 to determine a range to target, as in a lidar detection system. This information could be combined with the line of sight and own position information provided by the navigation system 485 to determine the target position.

Communication interface 480 may include any mechanism that facilitates communication via a network. For example, communication interface 480 may include a modem. Alternatively, communication interface 480 may include other mechanisms for assisting in communications with other devices and/or systems.

ROM may be included in memory 430 to include a conventional ROM device or another type of static storage device that stores static information and instructions for processor 420. A storage device may augment the ROM and may include any type of storage media, such as, for example, magnetic or optical recording media and its corresponding drive.

Input devices 460 may include one or more conventional mechanisms that permit a user to input information to the taggant detection unit 130, such as a keyboard, a mouse, a pen, a voice recognition device, touchpad, buttons, etc. Output devices 470 may include one or more conventional mechanisms that output information to the user, including a display, a printer, a copier, a scanner, a multi-function device, one or more speakers, or a medium, such as a memory, or a magnetic or optical disk and a corresponding disk drive.

The taggant detection unit 130 may perform such functions in response to processor 420 by executing sequences of instructions contained in a computer-readable medium, such as, for example, memory 430. Such instructions may be read into memory 430 from another computer-readable medium, such as a storage device or from a separate device via communication interface 480.

The taggant detection processing module 450 may receive signals from the taggant detector 490 and may identify the taggant 115 when detected by the taggant detector 490 and may output a signal to be displayed on the user interface 495. The signal on the user interface 495 may be an enhanced video showing images of the tagged personnel 120, a text message, a light or other indicator, etc. One possible example of how the taggant detection unit 130 may operate is that the taggant 115 may emit light of a first wavelength when excited by light of a second wavelength from the taggant sensor 490 of taggant detection unit 130.

The taggant detection unit 130 illustrated in FIGS. 1 and 4 and the related discussion are intended to provide a brief, general description of a suitable communication and processing environment in which the invention may be implemented. Although not required, the invention will be described, at least in part, in the general context of computer-executable instructions, such as program modules, being executed by the taggant detection unit 130, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the invention may be practiced in communication network environments with many types of communication equipment and computer system configurations, including personal computers, hand-held devices, multi-processor systems, microprocessor-based or programmable consumer electronics, and the like.

Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Embodiments within the scope of the present disclosure may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Although the above description may contain specific details, they should not be construed as limiting the claims in any way. Other configurations of the described embodiments of the disclosure are part of the scope of this disclosure. For example, the principles of the disclosure may be applied to each individual user where each user may individually deploy such a system. This enables each user to utilize the benefits of the disclosure even if any one of the large number of possible applications do not need the functionality described herein. In other words, there may be multiple instances of the components each processing the content in various possible ways. It does not necessarily need to be one system used by all end users. Accordingly, the appended claims and their legal equivalents should only define the disclosure, rather than any specific examples given.

We claim:

1. An apparatus for tagging multiple personnel for identification and tracking, comprising:

a taggant, the taggant being a chemical substance that adheres to an external surface of at least one of human skin, clothing and equipment of target personnel and that is undetectable by the human eye; and a taggant deployment mechanism in a form of an exploding projectile component, the exploding projectile component including the taggant, an explosive charge and a triggering mechanism, the taggant being mixed in with the explosive charge, wherein, after the taggant deployment mechanism is launched to an area, the triggering mechanism is activated to detonate the explosive charge causing an explosion that disperses the taggant over the area, the taggant adhering to the external surface of the at least one of human skin, clothing and equipment of the target personnel within the area over which the taggant is dispersed, the taggant being detectable only by a cooperating taggant detection unit.

2. The apparatus of claim 1, the exploding projectile component being one of a grenade, a missile warhead, an artillery shell warhead or a mortar warhead.

3. The apparatus of claim 1, wherein the taggant is quantum dots.

4. The apparatus of claim 1, wherein the taggant emits light of a first wavelength when excited by light of a second wavelength.

5. A method for tagging multiple personnel for identification and tracking, comprising:

providing a taggant, the taggant being a chemical substance that adheres to an external surface of at least one of human skin, clothing and equipment of target personnel and that is undetectable by the human eye;

providing a taggant deployment mechanism in a form of an exploding projectile component, the exploding projectile component including the taggant, an explosive charge and a triggering mechanism, the taggant being mixed in with the explosive charge;

launching the taggant deployment mechanism to an area;

activating the triggering mechanism when the taggant deployment mechanism is in the area to which the taggant deployment mechanism was launched to detonate the explosive charge causing an explosion that disperses the taggant over the area;

illuminating at least one of personnel and equipment with light of a second wavelength with an illuminator to cause the taggant to emit light of a first wavelength, the first wavelength being a different wavelength than the second wavelength; and detecting the light emitted by the taggant in the first wavelength with a taggant detection unit positioned remotely from the illuminated at least one of personnel and equipment, the taggant adhering to the external surface of the at least one of human skin, clothing and equipment of the target personnel within the area over which the taggant is dispersed.

6. The method of claim 5, the projectile being one of a grenade, a missile warhead, an artillery shell warhead or a mortar warhead.

7. The method of claim 5, wherein the taggant is quantum dots.

8. The method of claim 5, the taggant detection unit being one of handheld, vehicle-mounted, stationary object-mounted, and aircraft-mounted.

* * * * *